US007460797B2

(12) United States Patent
Yoshikawa

(10) Patent No.: US 7,460,797 B2
(45) Date of Patent: Dec. 2, 2008

(54) BELT TYPE FIXING DEVICE INCLUDING A CONTACT AND A NON-CONTACT TEMPERATURE SENSOR AND A REFLECTION TYPE SHEET SENSOR

(75) Inventor: Takahiro Yoshikawa, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 307 days.

(21) Appl. No.: 11/354,146

(22) Filed: Feb. 15, 2006

(65) Prior Publication Data

US 2006/0204265 A1 Sep. 14, 2006

(30) Foreign Application Priority Data

Mar. 11, 2005 (JP) ..... 2005-069181

(51) Int. Cl.
*G03G 15/20* (2006.01)

(52) U.S. Cl. ..... 399/22; 399/33; 399/69; 399/329

(58) Field of Classification Search ..... 399/22, 399/23, 69, 328, 329, 333
See application file for complete search history.

(56) References Cited

U.S. PATENT DOCUMENTS

| | | | | |
|---|---|---|---|---|
| 5,402,211 | A | 3/1995 | Yoshikawa | |
| 5,850,588 | A | 12/1998 | Yoshikawa | |
| 6,160,974 | A | 12/2000 | Yoshikawa et al. | |
| 6,501,914 | B2 * | 12/2002 | Yoshikawa | 399/22 |
| 6,757,502 | B2 | 6/2004 | Yoshikawa | |
| 6,823,149 | B2 | 11/2004 | Yoshikawa et al. | |
| 7,043,185 | B2 * | 5/2006 | Yoshikawa | 399/329 |
| 7,292,801 | B2 * | 11/2007 | Yoshikawa | 399/69 |
| 7,317,892 | B2 * | 1/2008 | Ito et al. | 399/329 |
| 2003/0231893 | A1 | 12/2003 | Yoshikawa | |
| 2004/0109709 | A1 | 6/2004 | Ishibashi et al. | |
| 2004/0264991 | A1 | 12/2004 | Yoshikawa | |

(Continued)

FOREIGN PATENT DOCUMENTS

| | | |
|---|---|---|
| JP | 11-305590 | 11/1999 |

(Continued)

OTHER PUBLICATIONS

U.S. Appl. No. 11/928,454, filed Oct. 30, 2007, Yoshikawa.

(Continued)

*Primary Examiner*—William J Royer
(74) *Attorney, Agent, or Firm*—Oblon, Spivak, McClelland, Maier & Neustadt, P.C.

(57) ABSTRACT

A belt type fixing device includes a fix roller, a press roller rotatable in pressing contact with the fix roller, a heat roller accommodating a heat source therein and a belt passed over the fix roller and heat roller. A non-contact type temperature sensor is positioned in a sheet passing range corresponding to the width of a minimum sheet size and assigned to the heat roller while a contact type temperature sensor is positioned outside of the sheet passing range. A controller prevents the heat source from being turned on if a temperature sensed by the non-contact type temperature sensor is short of a preselected temperature B when a temperature sensed by the contact type temperature sensor reaches a preselected temperature A assigned to the non-contact type temperature sensor. A reflection type sheet sensor determines whether or not a sheet is present on the belt.

9 Claims, 9 Drawing Sheets

U.S. PATENT DOCUMENTS

2005/0163543 A1 7/2005 Satoh et al.

FOREIGN PATENT DOCUMENTS

| | | |
|---|---|---|
| JP | 2000-155494 | 6/2000 |
| JP | 2000-242134 | 9/2000 |
| JP | 2001-125429 | 5/2001 |
| JP | 2001-201978 | 7/2001 |
| JP | 2004-126190 | 4/2004 |
| JP | 2004-258581 | 9/2004 |

OTHER PUBLICATIONS

U.S. Appl. No. 11/754,817, filed May 29, 2007, Yoshikawa.
U.S. Appl. No. 11/830,457, filed Jul. 30, 2007, Yoshikawa.
U.S. Appl. No. 11/521,506, filed Sep. 15, 2006, Yoshikawa.

* cited by examiner

FIG. 7

| HALF ROLLER DIAMETER (mm) | RESULT OF DECISION |
|---|---|
| 20 | ○ |
| 25 | ○ |
| 30 | ○ |
| 35 | △ |
| 40 | △ |
| 45 | × |

FIG. 9

| BELT (RUBBER+PFA) | RESULT OF DECISION |
|---|---|
| RED COLCOTHAR + PURE PFA | × |
| RED COLCOTHAR + CONDUCTIVE PFA | ○ |
| BLACK COLCOTHAR + PURE PFA | × |
| CONDUCTIVE + PURE PFA | ○ |
| CONDUCTIVE + CONDUCTIVE PFA | ○ |

BELT TYPE FIXING DEVICE INCLUDING A CONTACT AND A NON-CONTACT TEMPERATURE SENSOR AND A REFLECTION TYPE SHEET SENSOR

BACKGROUND OF THE INVENTION

1. Field of the Invention

The present invention relates to an electrophotographic copier, printer, facsimile apparatus or similar image forming apparatus and more particularly to a belt type fixing device for use in an electrophotographic image forming apparatus.

2. Description of the Background Art

It is a common practice with an electrophotographic image forming apparatus to use a fixing device including a heat roller or a heat belt. A problem with such a fixing device is that a sheet, jamming the outlet of the fixing device and carrying a solid image with a high toner ratio thereon, is apt to adhere to the heat roller or the heat belt because toner melted by heat is highly adhesive, as described in, e.g., Japanese patent laid-open publication No. 2004-258581. If a sheet is absent in the sensing range of a sheet sensor with the above sheet adhering to the heat roller or the heat belt, it is likely that a jam is determined to have already been settled, so that the heat roller or the heat belt is continuously heated.

Japanese patent laid-open publication No. 2001-20197, for example, teaches that the belt type fixing device is advantageous over the roller type of fixing device in that when the belt is passed over a plurality of shafts, the sheet, adhering to the belt, can be more easily removed from the belt than from the roller due to the angle of the belt. However, in the case of an oilless color fixing system, in particular, the sheet does not smoothly part from the belt, but is apt to remain on the belt, because a great amount of toner is deposited on the sheet and because oil is absent.

Assume that a conventional contact type temperature sensor is positioned in the sheet passing range of a fixing device of the type using a belt. Then, if the surface layer of the belt is covered with fluorine, the temperature sensor is apt to scratch the surface layer. To solve this problem, a non-contact type temperature sensor may be used, as taught in, e.g., Japanese patent laid-open publication Nos. 11-305590 and 2000-242134 by way of example. A non-contact type temperature sensor, however, brings about another problem that if a sheet jams a gap between the belt and the temperature sensor, then the temperature sensor senses the temperature of the sheet as the temperature of the belt. As a result, it is likely that a heat source disposed in a heat roller is turned on to heat the belt to an unexpected level and melts the surface layer of the belt or otherwise damages the belt.

As stated above, if a sheet adheres to the belt due to some trouble occurred during conveyance and if a sheet is absent in the sensing range of the sheet sensor, then a sheet jam is determined to have been settled with the result that the heat source starts heating the belt with the sheet remaining on the belt. Further, if a sheet remains in the gap between the non-contact type sheet sensor and the belt, then the sheet sensor senses the temperature of the sheet as the temperature of the belt and causes the heat source of the heat roller to generate heat.

SUMMARY OF THE INVENTION

It is an object of the present invention to provide a belt type fixing device using a non-contact type temperature sensor and capable of obviating damage ascribable to, e.g., a jamming sheet remaining in the sensing range of the temperature sensor to thereby surely detect errors.

A belt type fixing device of the present invention includes a fix roller, a press roller rotatable in pressing contact with the fix roller, a heat roller accommodating a heat source therein and a belt passed over the fix roller and heat roller. A non-contact type temperature sensor is positioned in a sheet passing range corresponding to the width of the minimum sheet size to be dealt with and assigned to the heat roller while a contact type temperature sensor is positioned outside of the sheet passing range. A controller prevents the heat source from being turned on if a temperature sensed by the non-contact type temperature sensor is short of a preselected temperature B when temperature sensed by the contact type temperature sensor reaches a preselected temperature A assigned to the non-contact type temperature sensor. A reflection type sheet sensor determines whether or not a sheet is present on the belt.

BRIEF DESCRIPTION OF THE DRAWINGS

The above and other objects, features and advantages of the present invention will become more apparent from the following detailed description taken with the accompanying drawings in which:

FIG. 7 is a table listing experimental results showing a relation between the diameter of a heat roller included in the illustrative embodiment and the separation of a sheet from the belt;

FIG. 9 is a table showing a relation between the color and structure of the belt and the separation of a sheet.

DESCRIPTION OF THE PREFERRED EMBODIMENT

Figure 1:
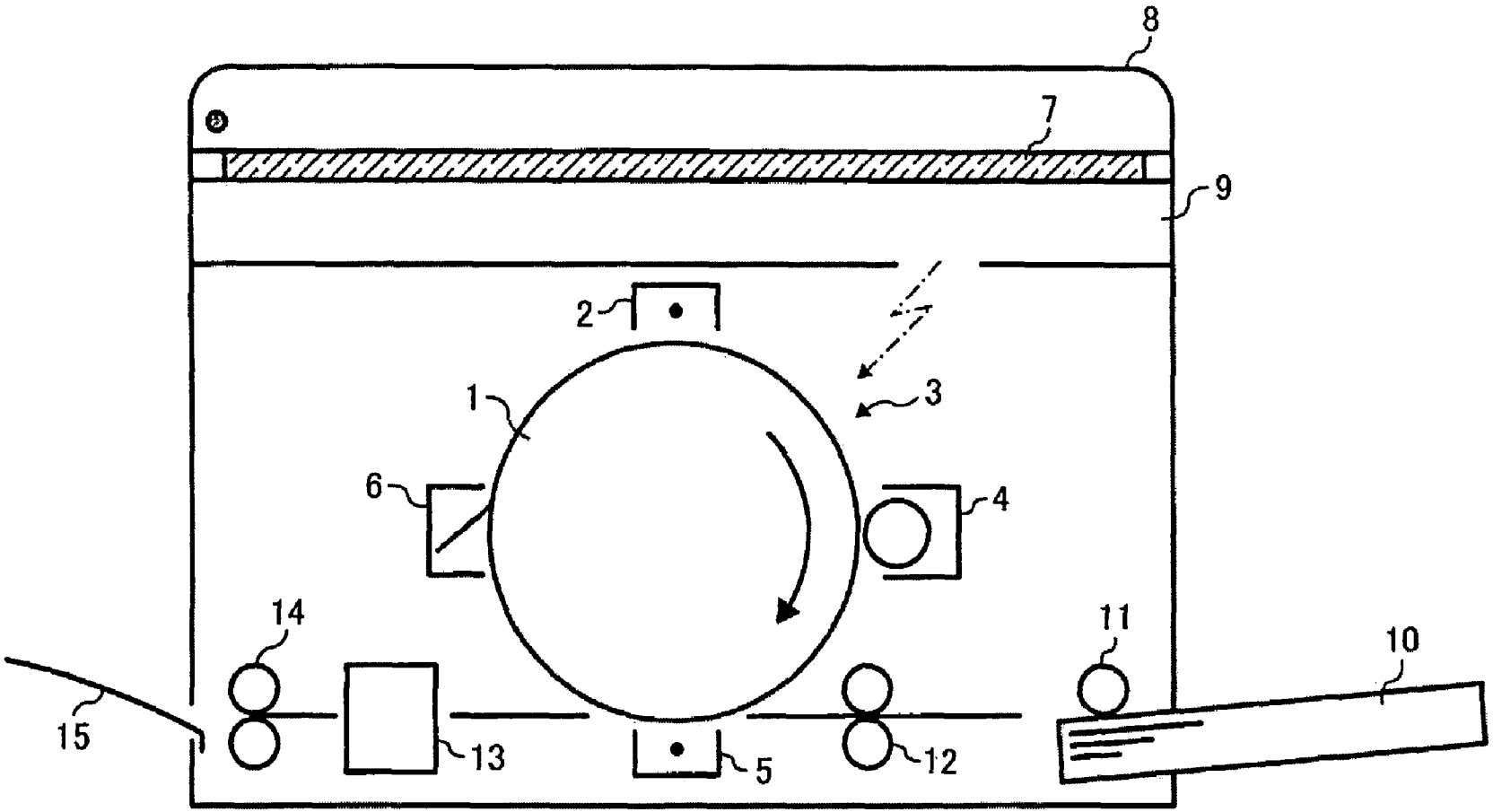
FIG. 1 is a view showing an electrophotographic image forming apparatus to which the present invention is applied.

Referring to FIG. 1 of the drawings, an electrophotographic image forming apparatus to which the present invention is applied is shown and implemented as a copier by way of example. As shown, the copier includes a photoconductive drum 1 which is a specific form of a photoconductive element. Arranged around the drum 1 are a charger 2, an exposing position 3, a developing unit 4, a transfer charger 5 and a drum cleaner 6.

A glass platen 7 is positioned in the upper portion of the copier body and on which a document is to be laid. A cover plate 8 for pressing the document against the glass platen 7 is positioned above the glass platen 7. Optics 9 are arranged below the glass platen 7 for optically reading the document laid on the glass platen 7 and exposing the drum 1 imagewise with the resulting image data. A sheet cassette 10 is located in the lower portion of the copier body and loaded with a stack of paper sheets or similar sheets.

A pickup roller 11 pays out the top sheet from the sheet cassette 10 toward a registration roller pair 12. The registration roller pair 12 stops the leading edge of the sheet in order to correct skew thereof and then drives it toward the transfer charger 5 in synchronism with the movement of a toner image formed on the drum 1. Subsequently, the sheet, carrying the toner image transferred thereto from the drum 1, is conveyed to a belt type fixing device 13 embodying the present invention. After the toner image has been fixed on the sheet by the heat and pressure of the fixing device 13, the sheet or copy is driven out to a print tray 15 by an outlet roller pair 14.

Figure 2:
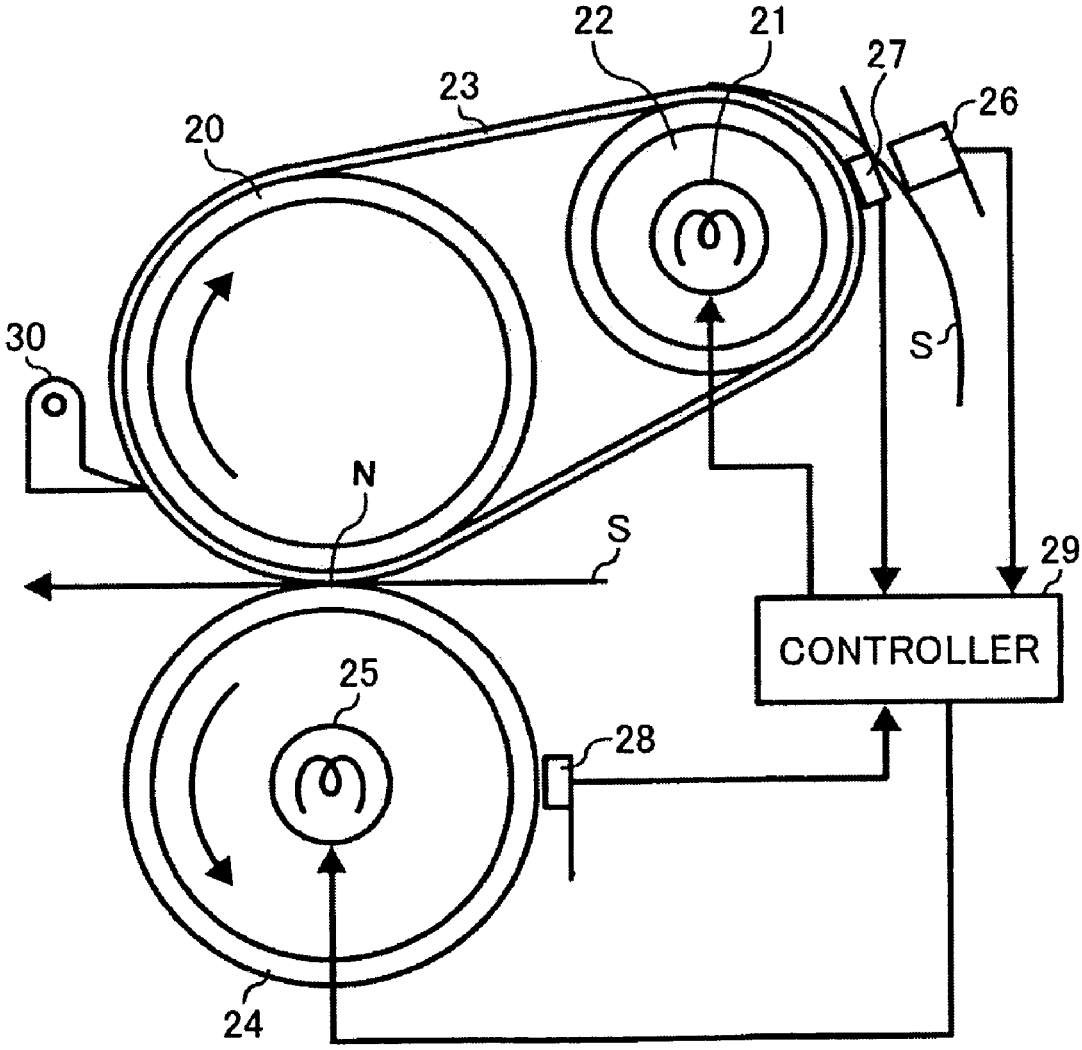
FIG. 2 is a view showing a belt type fixing device embodying the present invention and included in the apparatus of FIG. 1.

FIG. 2 shows a specific configuration of the belt type fixing device 13 embodying the present invention. As shown, the fixing device 13 includes a fix roller 20 and a heat roller 22 facing the fix roller 20 and implemented by a metallic pipe accommodating a heat source 21 therein. A belt 23 is passed over the fix roller 20 and the heat roller 22 and implemented as a laminate of a base implemented by a film of Ni (nickel), SUS (Steel Use Stainless defined in Japanese Industrial Standards) or similar metal or a film or PI (polyimide), PAI (polyamide imide) or similar resin, a silicone rubber layer formed on the base and a surface layer formed of fluorocarbon resin. The belt 23 is caused to turn by the fix roller or drive roller 20.

The fixing device 13 further includes a press roller 24 rotatable in pressing contact with the fix roller 20 with the intermediary of the belt 23. The press roller 24 accommodates a heat source 25 like the heat roller 22 and is covered with a rubber layer formed of fluorocarbon resin.

Temperature sensors 26 and 27 are responsive to the temperature of the heat roller 22 accommodating the heat source 21 while a temperature sensor 28 is responsive to the temperature of the press roller 24 accommodating the heat source 25. A controller, implemented by a CPU (Central Processing Unit), 29 controls the turn-on and turn-off of the heat source 21 and those of the heat source 25 in accordance with the outputs of the temperature sensors 26 and 27 and that of the temperature sensor 28, respectively.

The sheet, labeled S, carrying the toner image thereon is heated by the belt 23, which is heated by the fix roller 20 and heat roller 22, at a nip N where the fix roller 20 and the rubber layer of the press roller 24 are pressed against each other, so that the toner image is fixed on the sheet S by heat and pressure.

Figure 3:
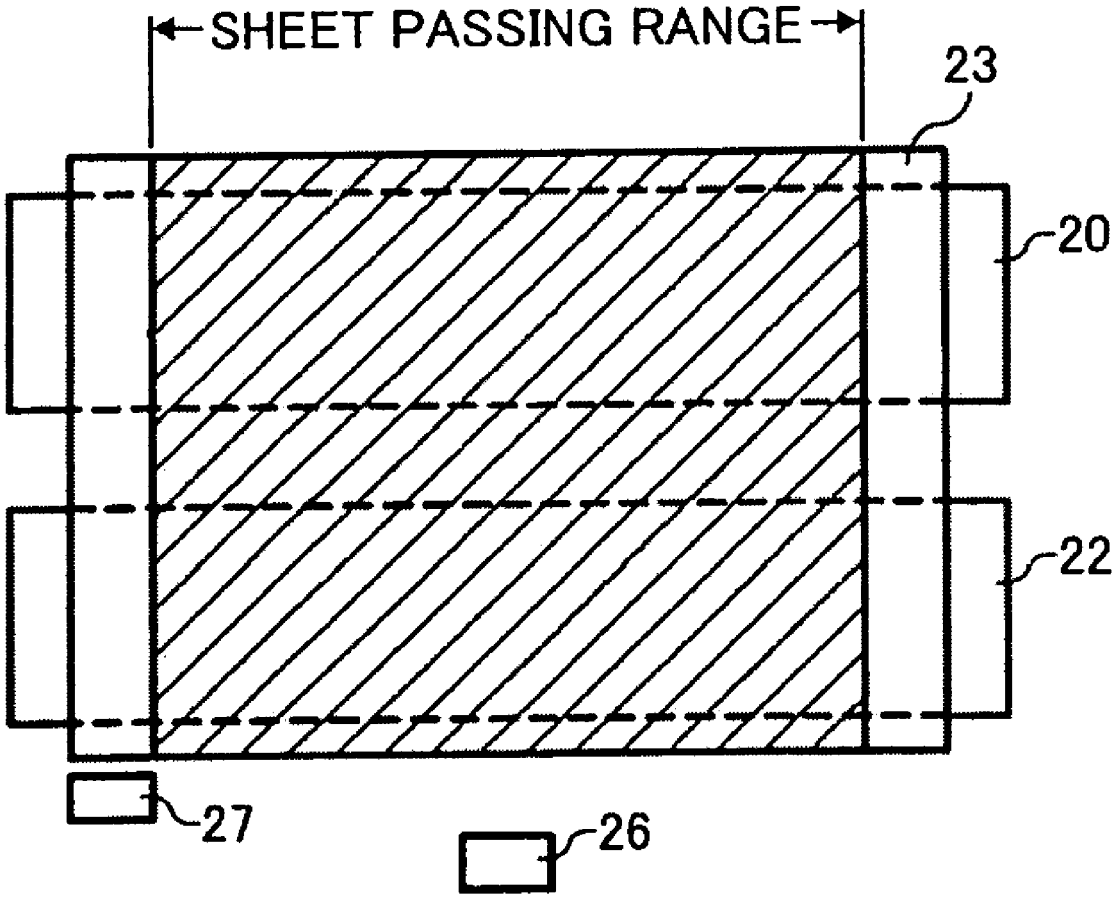
FIG. 3 shows the positions of a contact type and a non-contact type temperature sensor included in the illustrative embodiment relative to a belt.

Should the temperature sensors 26 and 27 assigned to the belt 23 contact the belt 23, they would scratch the fluorocarbon resin layer of the belt 23 and cause the resulting scratches to be transferred to a toner image formed on the sheet S. In light of this, as shown in FIG. 3, the temperature sensor 26 positioned in a sheet passing range, which is equal to the width of the minimum sheet size, is implemented as a non-contact type temperature sensor while the temperature sensor 27 positioned outside of the sheet passing range is implemented as a contact type sensor. The temperature sensor 28 assigned to the press roller 24 is also implemented as a contact type temperature sensor because toner deposits on the press roller 24 little and because the temperature sensor 28 scratches fluorocarbon resin little and contacts the reverse side of the sheet S.

If a great amount of toner is present on the sheet S (i.e., if an image area ratio on the sheet S is great) then the toner on the sheet S, that comes out of the nip N between the fix roller 20 and the press roller 24 is extremely adhesive because the toner has been melted by heat. Usually, a peeler 30 (FIG. 1) or similar peeling member is positioned to peel off the sheet S from the belt 23. However, assume that the toner deposits on the leading edge of the sheet S due to some error or that the leading edge of the sheet S is caught by some member and then folded with the result that the end of the sheet lacks a blank portion or margin. Then, the sheet S is apt to adhere to the belt 23 and be conveyed thereby to the sensing range of the non-contact type temperature sensor 26, jamming the gap between the belt 23 and the temperature sensor 26.

In the illustrative embodiment, even if a jamming sheet is present between the belt 23 and the non-contact type temperature sensor 26, the contact type temperature sensor 27, positioned outside of the sheet passing range, can accurately sense the temperature of the belt 23 because the above sheet is not conveyed to the contact type temperature sensor 27.

Figure 4:
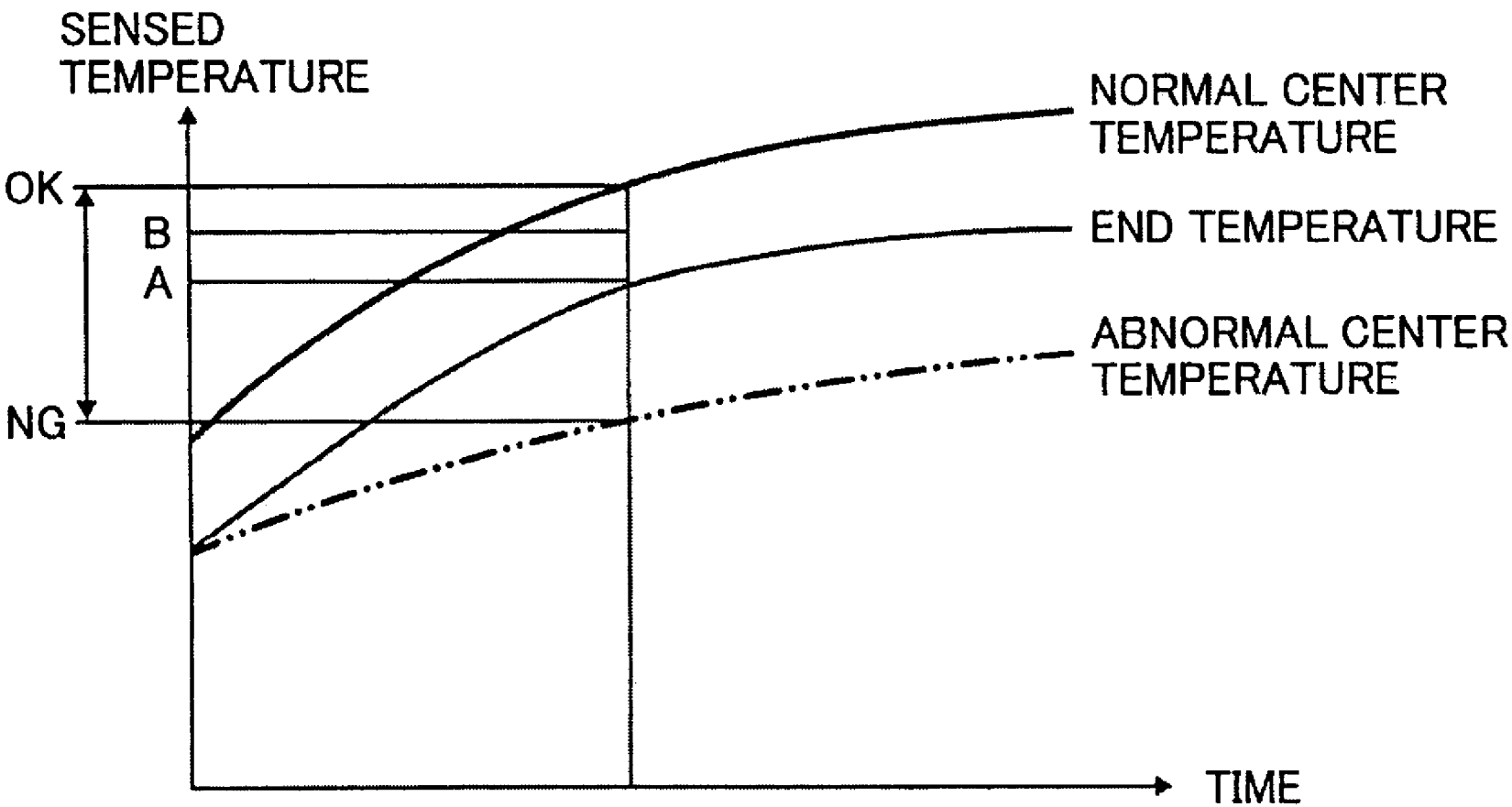
FIG. 4 shows curves representative of specific temperatures sensed in the illustrative embodiment.

As shown in FIG. 4, assume that controller 29 determines that when temperature sensed by the contact type temperature sensor 27 reaches a preselected temperature A during reloading, temperature sensed by the non-contact type temperature sensor 26, which faces the center of the belt 23, is B lower than normal temperature. Then, the controller 29 determines that a jamming sheet is present on the non-contact type temperature sensor 26 for thereby enhancing accurate detection of an error or NG (No Good). Reloading mentioned above refers to the generation of heat by the heat source 21 disposed in the heat roller 22 after the removal of a jamming sheet, i.e., a jam recovery.

Figure 5:
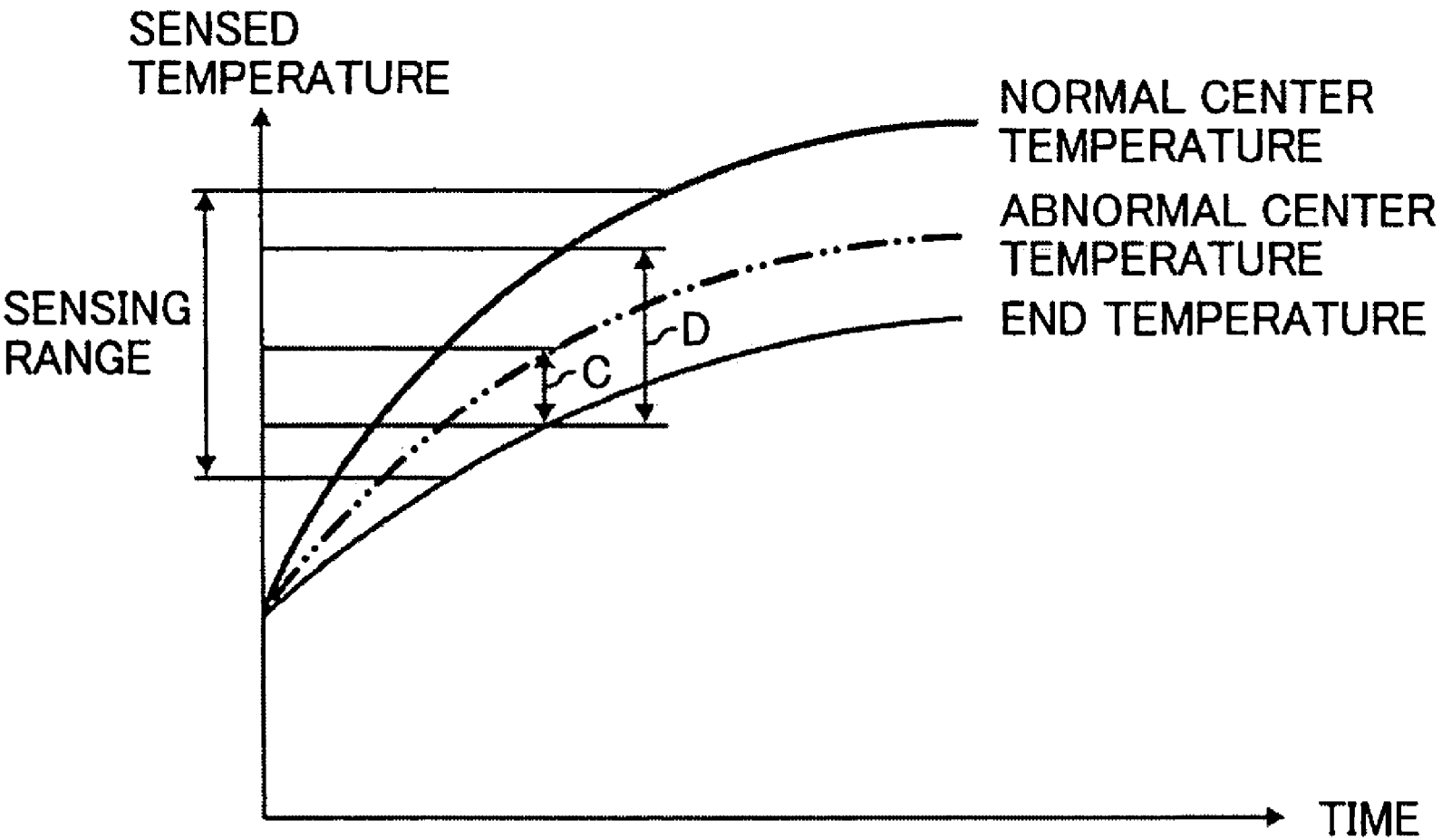
FIG. 5 shows curves representative of other specific temperatures sensed in the illustrative embodiment.

Further, as shown in FIG. 5, assume that the controller 29 determines that a difference between temperature sensed by the non-contact type temperature sensor 26 and temperature sensed by the contact type temperature sensor 27 is C smaller than a temperature difference D expected during reloading. Then, the controller 29 determines that a jamming sheet is present, also enhancing accurate detection of an error.

As stated above, the contact type temperature sensor 27 is capable of detecting an error when temperature lies in a normal reloading temperature range, which is from about 160° C. to about 180° C. This prevents, e.g., the fluorocarbon resin layer of the belt 23 from being melted or otherwise damaged.

When the sheet S fully, closely adheres to the surface of the belt 23, the sheet S is heated to the same temperature as the belt 23. Furthermore, because sheets, in general, have a small thermal capacity, the delay of temperature elevation of a thin sheet during reloading is small and is smaller than a difference ascribable to, e.g., the variation of an input voltage.

Figure 6:
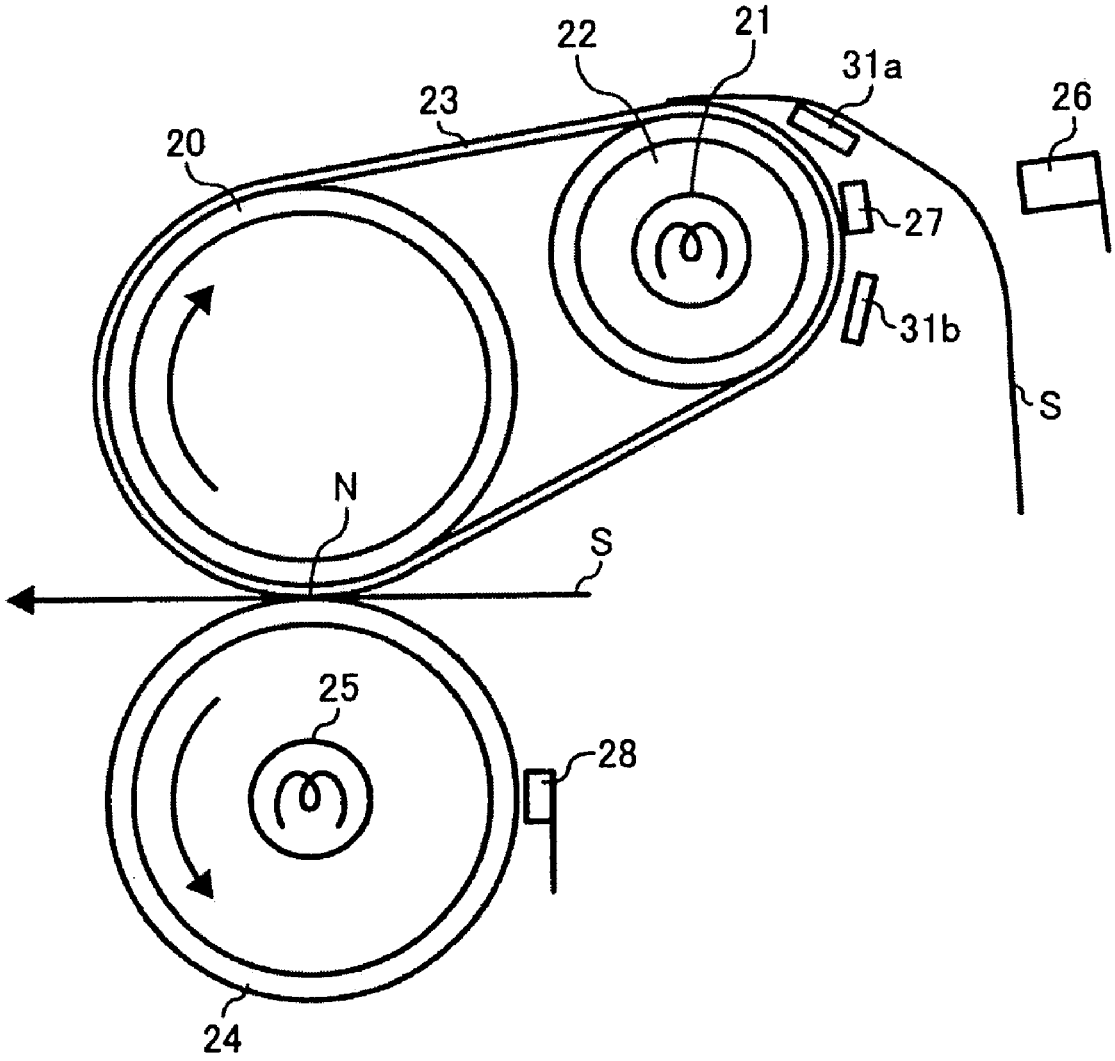
FIG. 6 is a view showing a modification of the illustrative embodiment including a sheet separating mechanism.

FIG. 6 shows a modification of the illustrative embodiment configured to cope with the above occurrences. As shown, a sheet separating mechanism 31*a* or 31*b* implemented by, e.g., a thin plate is positioned upstream or downstream of the non-contact type temperature sensor 26 in the direction of sheet conveyance in order to promote the separation of the sheet S from the belt 23. In this configuration, when the sheet S adhered to the belt 23 is brought into the sensing range of the non-contact type temperature sensor 26, the sheet separating mechanism 31*a* or 31*b* lifts the sheet S away from the belt 23. Consequently, the temperature sensor 26 is allowed to sense the temperature of the sheet S lifted in the air, so that the temperature difference in the normal condition and the temperature difference in the abnormal condition are clearly distinguished from each other. This is successful to enhance reliable sheet detection.

FIG. 7 is a table listing the results of experiments conducted to determine a relation between the diameter of the heat roller 22 and the separation of a jamming sheet from the belt 23. As shown, when the diameter of the heat roller 22 was as small as 20 mm to 30 mm, a jamming sheet could not be easily separated from the belt 23, as indicated by circles. Also, when the roller diameter was between 35 mm and 40 mm, a sheet with a two-color, solid toner image could be separated, but a sheet with a three-color, solid toner image could not be separated, as indicated by triangles in FIG. 7. Further, when the roller diameter was as great as 45 mm, even a sheet with a two-color, solid toner image could not be separated from the belt 23, as indicated by a cross in FIG. 7. Usually, the amount of toner deposition on a sheet is regulated such that the total amount of toner forming a three-color image is close to the total amount of toner forming a two-color image, so that a sheet with a two-color image can be separated.

It will thus be seen that when the diameter of the heat roller 22 is 40 mm or below, it is possible to lift the sheet S away from the belt 23 present at the non-contact type temperature sensor 26, allowing the temperature sensor 26 to sense the temperature of the sheet S lifted in the air. This clearly distinguishes the temperature difference in the normal condition and the temperature condition in the abnormal condition.

Figure 8:
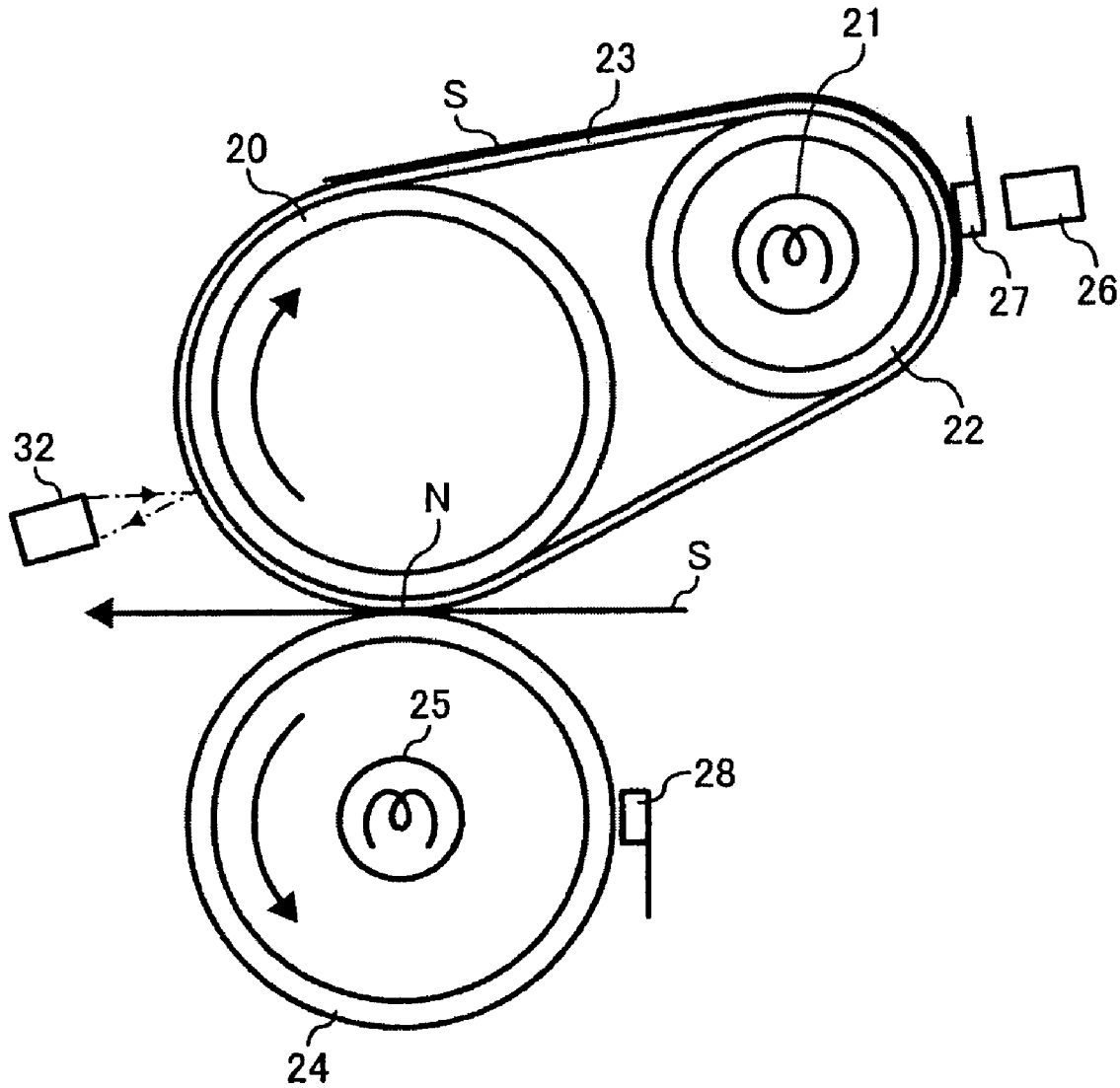
FIG. 8 is a view showing another modification of the illustrative embodiment including a reflection type photosensor.

FIG. 8 shows another modification of the illustrative embodiment using a reflection type photosensor 32 as a sheet sensor. The photosensor 32 emits light toward the belt 23 and then senses a variation in light reflected from the belt 23. In this configuration, when the belt 23 is caused to turn in the event of jam recovery, the photosensor 32 senses the sheet S wrapped around the belt 23 also and therefore backs up the non-contact type temperature sensor 26 and contact type temperature sensor 27 sensing the sheet S.

When the photosensor 32 emits light toward the belt 23, it is likely that the resulting reflection is erroneous due to the color of the belt 23. FIG. 9 is a table listing experimental results relating to the color of the belt 32. As shown, when the fluorocarbon resin, forming the surface layer of the belt 23, was implemented by PFA (polytetrafluoroethylene-perfluoroalkyl vinyl ether) resin, the surface layer or PFA resin itself is usually colorless and transparent, it was possible to color the belt 23 black if silicone rubber, underlying the surface layer, is made conductive, obviating the erroneous detection of a sheet which is usually substantially white. However, when colcothar contained in silicone rubber was colored black, the belt 23 did not appear black and caused an error to occur.

Thus, the experimental results shown in FIG. 9 show that the belt 23 appears black if the surface layer is formed of conductive PFA or if silicone rubber is made conductive, enhancing reliable sheet sensing.

In summary, in accordance with the present invention, even if a sheet is left on a belt due to a jam or similar trouble, a contact type temperature sensor, positioned outside of a sheet passing range, can sense temperature without being effected by the sheet. Further, whether or not a sheet is left on the belt may be determined on the basis of temperature sensed by the contact type temperature sensor and temperature sensed by a non-contact type temperature sensor. Moreover, a reflection type sheet sensor may be used to back up the above two temperature sensors when the temperature sensors fail to operate. Thus, the present invention is capable of enhancing reliable sheet sensing to thereby free a fixing device from erroneous or excessive heating.

It should be noted that the present invention is applicable to a fixing station included in an electrophotographic image forming process executed by the engine of, e.g., a facsimile apparatus or a copier and advantageously applicable to, among others, a belt type fixing device including a contact type and a non-contact type temperature sensor with which whether or not a sheet is left on a belt can be determined.

Various modifications will become possible for those skilled in the art after receiving the teachings of the present disclosure without departing from the scope thereof.

What is claimed is:

1. A belt type fixing device comprising:

a fix roller;

a heat roller accommodating a heat source therein;

a belt passed over said fix roller and said heat roller;

a press roller rotatable in pressing contact with said fix roller with the belt therebetween;

a non-contact type temperature sensor positioned in a sheet passing range corresponding to a width of a minimum sheet size and assigned to said heat roller;

a contact type temperature sensor positioned outside of said sheet passing range;

a controller configured to prevent the heat source from being turned on if a temperature sensed by said non-contact type temperature sensor is short of a preselected temperature B when a temperature sensed by said contact type temperature sensor reaches a preselected temperature A assigned to said non-contact type temperature sensor; and a reflection type sheet sensor configured to determine whether or not a sheet is present on said belt.

2. The fixing device as claimed in claim 1, wherein said controller prevents the heat source from being turned on when a difference between the temperature determined by said non-contact type temperature sensor and the temperature sensed by said contact type temperature sensor is brought out of a preselected difference range expected in a normal condition.

3. The fixing device as claimed in claim 1, further comprising a separating member positioned upstream or downstream of said non-contact type temperature sensor associated with said heat roller for separating the sheet from said belt.

4. The fixing device as claimed in claim 1, wherein said heat roller has a diameter of 40 mm or below.

5. The fixing device as claimed in claim 1, wherein after said belt has been heated above any preselected temperature and rotated at a time of reloading, said reflection type sheet sensor determines whether or not the sheet is present on said belt.

6. The fixing device as claimed in claim 1, wherein a surface of said belt is made black by being coated with conductive PFA resin or with conductive silicone rubber being positioned below PFA resin.

7. An image forming apparatus including a belt type fixing device, said belt type fixing device comprising:

a fix roller;

a heat roller accommodating a heat source therein;

a belt passed over said fix roller and said heat roller;

a press roller rotatable in pressing contact with said fix roller with the belt therebetween;

a non-contact type temperature sensor positioned in a sheet passing range corresponding to a width of a minimum sheet size and assigned to said heat roller;

a contact type temperature sensor positioned outside of said sheet passing range; and a controller configured to prevent the heat source from being turned on if a temperature sensed by said non-contact type temperature sensor is short of a preselected temperature B when a temperature sensed by said contact type temperature sensor reached a preselected temperature A assigned to said non-contact type temperature sensor.

8. The image forming apparatus as claimed in claim 7, wherein said belt type fixing device further comprises a reflection type sheet senor configured to determined whether or not a sheet is present on said belt.

9. The image forming apparatus as claimed in claim 8, wherein after said belt has been heated above any preselected temperature and rotated at a time of reloading, said reflection type sheet sensor determines whether or not the sheet is present on said belt.

* * * * *